US011286698B2

(12) United States Patent
Braden et al.

(10) Patent No.: US 11,286,698 B2
(45) Date of Patent: Mar. 29, 2022

(54) COOKING APPLIANCE HAVING A LOAD-BEARING DOOR

(71) Applicants: BSH Home Appliances Corporation, Irvine, CA (US); BSH Hausgeräte GmbH, Munich (DE)

(72) Inventors: Ben Braden, Lafollette, TN (US); Ronald Allen Diehl, LaFollette, TN (US); Josiah Fronckowiak, LaFollette, TN (US); Shaun Phillips, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 228 days.

(21) Appl. No.: 16/454,109

(22) Filed: Jun. 27, 2019

(65) Prior Publication Data

US 2020/0408017 A1 Dec. 31, 2020

(51) Int. Cl.

| | |
|---|---|
| ***E05D 15/48*** | (2006.01) |
| ***F24C 15/02*** | (2006.01) |
| ***E05F 15/616*** | (2015.01) |
| ***E05D 15/58*** | (2006.01) |
| ***E05D 15/40*** | (2006.01) |

(52) U.S. Cl.

CPC ..... *E05D 15/48* (2013.01); *E05D 15/40* (2013.01); *E05D 15/582* (2013.01); *E05F 15/616* (2015.01); *F24C 15/023* (2013.01); *F24C 15/026* (2013.01); *E05D 2015/485* (2013.01); *E05D 2015/586* (2013.01); *E05Y 2900/308* (2013.01)

(58) Field of Classification Search

CPC ..... E05D 15/48; E05D 15/582; E05D 15/40; E05D 15/44; E05D 2015/485; E05D 2015/586; F24C 15/023; F24C 15/026; E05F 15/616; E05Y 2900/308

USPC ..... 49/149, 176

See application file for complete search history.

(56) References Cited

U.S. PATENT DOCUMENTS

| | | | | |
|---|---|---|---|---|
| 2,121,284 A * | 6/1938 | Challet | F24C 15/023 126/198 |
| 3,157,175 A | 11/1964 | Pearce et al. | |
| 4,324,072 A * | 4/1982 | Sterner, Jr. | E05D 15/10 49/129 |
| 10,358,854 B1 * | 7/2019 | Guygaew | E05B 81/08 |
| 2005/0134158 A1 * | 6/2005 | Bartmann | F24C 15/026 312/319.2 |

(Continued)

FOREIGN PATENT DOCUMENTS

| | | |
|---|---|---|
| DE | 683497 C | 11/1939 |
| DE | 4023949 A1 | 8/1991 |

(Continued)

*Primary Examiner* — Marcus Menezes

(74) *Attorney, Agent, or Firm* — Michael E. Tschupp; Andre Pallapies; Brandon G. Braun

(57) ABSTRACT

Cooking appliances described herein may include an oven and a cooktop disposed above the oven. The oven may have an oven cavity and an oven door configured to open and close the oven cavity by pivoting about a horizontal axis. A linear actuator may be coupled to the oven door and configured to reposition the oven door in a vertical direction. Using this apparatus, a user may be assisted by the vertically-repositionable oven door when lifting and lowering objects.

15 Claims, 11 Drawing Sheets

(56) References Cited

U.S. PATENT DOCUMENTS

| | | | | |
|---|---|---|---|---|
| 2007/0194000 | A1 | 8/2007 | Baumeister et al. | |
| 2010/0140247 | A1* | 6/2010 | Watkins | F24C 7/00 219/391 |
| 2012/0060821 | A1* | 3/2012 | McNamee | E05D 15/56 126/197 |
| 2016/0374157 | A1* | 12/2016 | Ham | F24C 15/023 |
| 2017/0122016 | A1* | 5/2017 | Lampitelli | E05D 11/0081 |
| 2017/0321903 | A1* | 11/2017 | Jadhav | F24C 15/023 |
| 2019/0350407 | A1* | 11/2019 | Sharpe | F24C 15/028 |
| 2019/0380487 | A1* | 12/2019 | Sobolewski | E05D 11/06 |
| 2019/0383496 | A1* | 12/2019 | Scalf | F24C 15/023 |
| 2021/0045564 | A1* | 2/2021 | Duckers | E05F 15/673 |
| 2021/0063077 | A1* | 3/2021 | Shultz | E05D 15/582 |

FOREIGN PATENT DOCUMENTS

| | | | | |
|---|---|---|---|---|
| DE | 102010063045 | A1 | 12/2011 | |
| FR | 2705138 | A1 | 11/1994 | |
| KR | 20080095552 | A | 10/2008 | |
| WO | WO-2019034274 | A1 * | 2/2019 | E05D 15/46 |

* cited by examiner

COOKING APPLIANCE HAVING A LOAD-BEARING DOOR

FIELD

This disclosure relates to systems and methods for cooking appliances. More specifically, the disclosed embodiments relate to cooking appliances having front-opening oven doors.

INTRODUCTION

The use of cooking appliances such as ranges or wall ovens is integral to many food preparation tasks. Some larger food items, specifically those prepared in glass or metal items of bakeware or cookware, can be heavy and difficult to maneuver. Preparing food using some cooking appliances, specifically ranges and floor-level wall ovens, may involve bending and/or twisting to move heavy items. This may be difficult or impossible for elderly or disabled users, who are weaker or less mobile than typical oven users. Able-bodied users may also experience challenges transporting awkward or heavy items into and out of cooking appliances. There is a need for cooking appliances configured to assist with this situation.

SUMMARY

The present disclosure provides systems, apparatuses, and methods relating to cooking appliances (e.g., ovens and ranges) having vertically translating doors.

In some embodiments, a cooking appliance may include an appliance body; an appliance door coupled to the appliance body, such that the appliance door is pivotable between a horizontal, fully open position and a vertical, fully closed position; and a linear actuator operatively connected to the appliance door such that the linear actuator is selectively operable to raise the appliance door along a vertical axis when the appliance door is in the fully open position.

In some embodiments, a cooking appliance may include an oven having an oven cavity and an oven door configured to open and close the oven cavity by pivoting about a horizontal axis; a cooktop disposed above the oven; and a linear actuator coupled to the oven door and configured to reposition the oven door in a vertical direction.

In some embodiments, a method for vertically repositioning a door of a cooking appliance may include: receiving, at a controller, an input from a user interface, the input indicating a first command to change a height of a door of the cooking appliance, wherein the door is manually pivotable about a horizontal axis; and in response to a sensed input indicating that the door is open, activating a linear actuator to change the height of the door.

Features, functions, and advantages may be achieved independently in various embodiments of the present disclosure, or may be combined in yet other embodiments, further details of which can be seen with reference to the following description and drawings.

DETAILED DESCRIPTION

Figure 1:
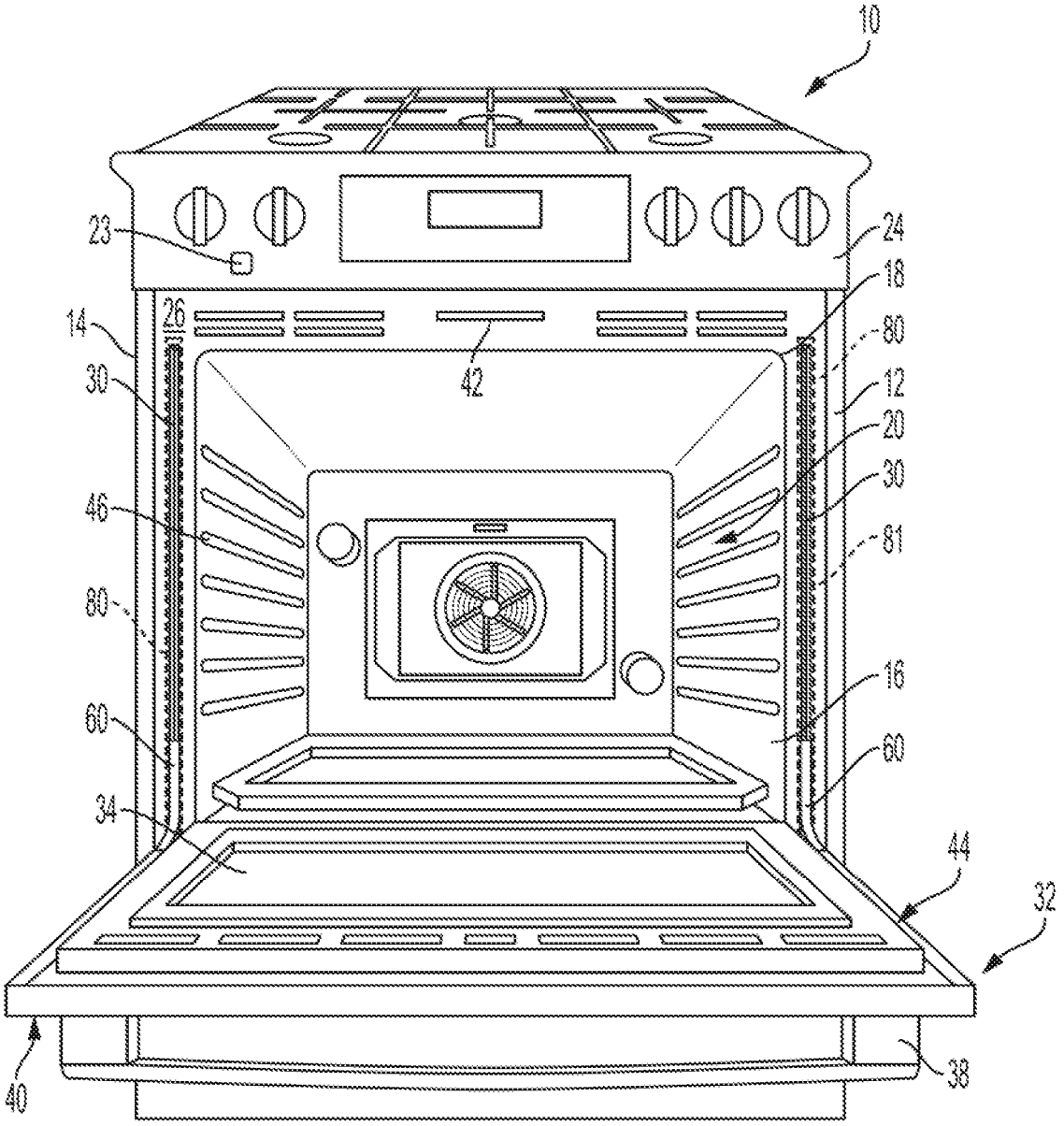
FIG. 1 is a front view of an illustrative cooking appliance having a vertically translating door in accordance with aspects of the present disclosure.

Various aspects and examples of a cooking appliance having a translatable, load-bearing door and related methods are described below and illustrated in the associated drawings. Unless otherwise specified, a cooking appliance in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A through I, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Coupled" means connected, either permanently or releasably, whether directly or indirectly through intervening components.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

Overview

In general, a cooking appliance in accordance with the present teachings includes an appliance body, an appliance door, and a linear actuator received within the appliance body and coupled to the appliance door by a hinge, wherein the linear actuator is configured to raise and lower the door when the door is in a substantially horizontal position. Accordingly, the appliance door is transitionable between a closed configuration, an open configuration, and a plurality of raised configurations. The door may be configured to transport (e.g., translate, move, relocate, lift, and/or lower) an object from a first height to a second height, such that a user of the appliance is assisted with placing an object (e.g., food) in the cooking appliance, removing the object from the cooking appliance, and/or transferring the object from the cooking appliance to a different surface.

The appliance body may include an exterior housing and an appliance muffle defining a cavity (e.g., an oven cavity). The exterior housing and an exterior wall of the appliance muffle may collectively define a hardware compartment including the linear actuator. The housing may include an opening in a front wall, configured to give a user access to the appliance cavity. The cavity may include first and second rack receivers located on interior surfaces of the appliance housing. The appliance body may include a control panel and/or other human machine interface(s) disposed on the front wall of the housing.

The appliance door includes a hinge defining a pivot axis, such that the door is pivotable between (a) a closed position, with the door oriented substantially vertical (i.e., perpendicular to an underlying support surface or floor) and covering the opening of the appliance housing, and (b) an open configuration, with the door oriented substantially horizontal (i.e., parallel to the support surface or floor). A third rack receiver may be disposed on an interior surface of the door. The appliance may include a rack configured to be removably receivable in each of the first, second, and third rack receivers.

A collar or other interface mechanism may be coupled to the hinge(s) of the appliance door, and may be configured to operably interface with the linear actuator. When the door is open, the linear actuator may operate to transition the appliance door between a first vertical height and a second vertical height (i.e., by raising or lowering the door). In some examples, the linear actuator may include a leadscrew and a drive motor. In some examples, the linear actuator may comprise a pneumatic or hydraulic piston, and/or may be counterbalanced or spring-assisted. In examples utilizing a drive motor, the drive motor may be controlled by a motor controller configured to halt the drive motor when the door is at a selected height. The selected height may correspond to a vertical position of the first or the second rack receiver within the oven cavity. Raising and/or lowering of the door may be achieved by way of a switch or toggle configured to activate the motor controller and disposed on the control panel (or at any other suitable location on the appliance). In some examples, the motor controller may be activated remotely (e.g., via a controlling software application running on a separate device).

The hinge of the appliance door may include a mechanical linkage and a counterweight. In some examples, the mechanical linkage may comprise a four-bar linkage configured as a scissor-hinge and transitionable between a collapsed configuration and an extended configuration. The counterweight may be configured to balance the weight of the door, e.g., to reduce a torque on the linear actuator, and may be disposed within the hardware compartment of the appliance body, i.e., on an opposite side of the linear actuator from the door. The mechanical linkage may be received within the hardware compartment in the collapsed configuration. Extending the hinge may transition the door from a position adjacent the appliance body to a position where the top surface of the door is parallel to a top surface of the appliance body. The hinge may be configured to enable the door to clear an obstruction such as a bullnose or the control panel, which may protrude from the front surface of the appliance body. This raised position may facilitate sliding of the rack from the third rack receiver (i.e., on the door) onto the top surface of the appliance body (e.g., onto a burner grid or cooktop).

In general, a method for transferring an object into and out of an oven may include moving the object from a first horizontal position within the oven to a second horizontal position disposed on a door of the oven, vertically translating the door of the oven from a first height to a second height using a linear actuator, and moving the object from the door of the oven to a third horizontal position on a cooktop or again inside the oven. The third horizontal position may be directly above the first horizontal position. The first horizontal position at the first height and the third horizontal position at the second height may correspond to first and second rack receivers disposed on interior surfaces of the oven cavity.

In some examples, the method may further include extending a mechanical linkage such that the door moves upward and away from the oven face (e.g., to place the door in a position generally coplanar with a top surface of the range.

Examples, Components, and Alternatives

The following sections describe selected aspects of exemplary cooking appliances including load-bearing, vertically translatable doors as well as related systems and/or methods. The examples in these sections are intended for illustration and should not be interpreted as limiting the scope of the present disclosure. Each section may include one or more distinct embodiments or examples, and/or contextual or related information, function, and/or structure.

A. First Illustrative Cooking Appliance

As shown in FIGS. 1-5, this section describes an illustrative cooking appliance having a load-bearing, vertically translatable door.

Cooking appliance 10 includes an appliance body 12 having an appliance housing 14, and an appliance muffle 16 defining a cavity 20. A door 32 may be coupled to appliance body 12 by a hinge 60. Appliance 10 may include any suitable cooking or heating appliance, such as a range, wall oven, toaster oven, convection oven, steam oven, microwave, and/or the like. Appliance 10 may be configured to heat an item placed within cavity 20 using gas heat, electric heat, convection heat, induction heat, microwaves, and/or any other suitable type of energy, or any combination thereof.

Cooking appliance housing 14 and an exterior wall 18 of appliance muffle 16 collectively define a hardware compartment 22. Appliance muffle 16 may insulate appliance cavity 20, among other things helping to insulate hardware compartment 22 from the heat of cavity 20. Appliance cavity 20 may include first and second rack receivers 46 disposed on an interior surface of appliance muffle wall 18. Appliance cavity 20 may have any number of such rack receivers disposed on lateral and/or rear faces of the inner cavity walls.

Cooking appliance 10 may further include a control panel 24 disposed on a front surface 26 of appliance housing 14. Control panel 24 may include one or more human-machine interfaces (HMI) 88 (e.g., burner control knobs, oven control panels, touch screens, buttons, and/or the like). Housing 14 may include an opening in front surface 26 providing access to appliance cavity 20. Housing 14 may further include slots 30 extending vertically along front surface 26 and disposed adjacent to appliance cavity 20. Slots 30 are configured to provide an unimpeded vertical range of motion for the door hinge mechanism during raising and lowering, as described further below.

Door 32 may be coupled to appliance body 12 by one or more hinges 60. In some embodiments, appliance 10 may include two hinges 60, one on either side of the oven cavity. Door 32 may include a window 34, e.g., set within a recess in the door. Door 32 may further include a handle 38 disposed on an exterior surface 40 of door 32 to facilitate manual opening and closing.

A door locking mechanism 42 may include hooks or fasteners disposed on an interior surface 44 of door 32 and a slot or receiver disposed on front surface 26 of housing 14. Locking mechanism 42 may be configured to selectively secure door 32 in a closed configuration 62, where door 32 is oriented substantially vertical and covers appliance cavity 20. In some examples, the hooks or fasteners of locking mechanism 42 may be released by exerting downward or outward pressure on handle 38 of door 32. Appliance 10 may include additional safety features in addition to locking mechanism 42, such as a position sensor or switch configured to sense an orientation or position of door 32, and a motor controller or mechanical interlocks that halt heating operations of the appliance cavity when the door is in a specified orientation or height.

Door 32 may include strengthening features configured to increase the load-bearing capabilities of the door. In some examples, door 32 may include a crossbar extending across an interior surface 44 of the door, between any of hinges 60. In some examples, door 32 may include a damping mechanism. This damping mechanism may be hydraulic, pneumatic, and/or include springs, cables, or any other shock-absorbing components.

Door 32 may include a third rack receiver 45 disposed on interior surface 44 of the door. Rack receiver 45 may include any suitable retaining elements configured to receive and selectively retain an oven rack. For example, rack receiver 45 may include a pair of parallel tracks or rails, each disposed laterally adjacent window 34. Rack receiver 45 may be configured to slidably receive a wire rack 48. Rack 48 may be slidably transitionable between door rack receiver 45 and any cavity rack receiver 46 and/or onto a top surface of the range (if applicable).

Hinge 60 is disposed between appliance body 12 and door 32. Hinge 60 is coupled to a collar or truck, also referred to as a carriage 82 of a linear actuator 80. (See FIGS. 2-3). Hinge 60 extends through slots 30 of housing 14, thereby coupling the linear actuator inside the housing to the door outside the housing. Hinge 60 may include any type of hinge configured to facilitate pivoting of door 32 between a vertical orientation and a horizontal orientation. Hinge 60 may include a simple hinge, a concealed hinge (e.g., a cup hinge or a Euro hinge), a hinge including adjustable attachment zones, or any hinge allowing for a fully horizontal open configuration. Hinge 60 may include a damping mechanism incorporated within the hinge. The damping mechanism may be hydraulic, pneumatic, and/or include springs, cables, or any other shock-absorbing and/or biasing components. In some examples, a bracket may extend from the door or from the housing below hinge 60, and be configured to brace the door when the door is open, thereby providing further support.

Figure 3:
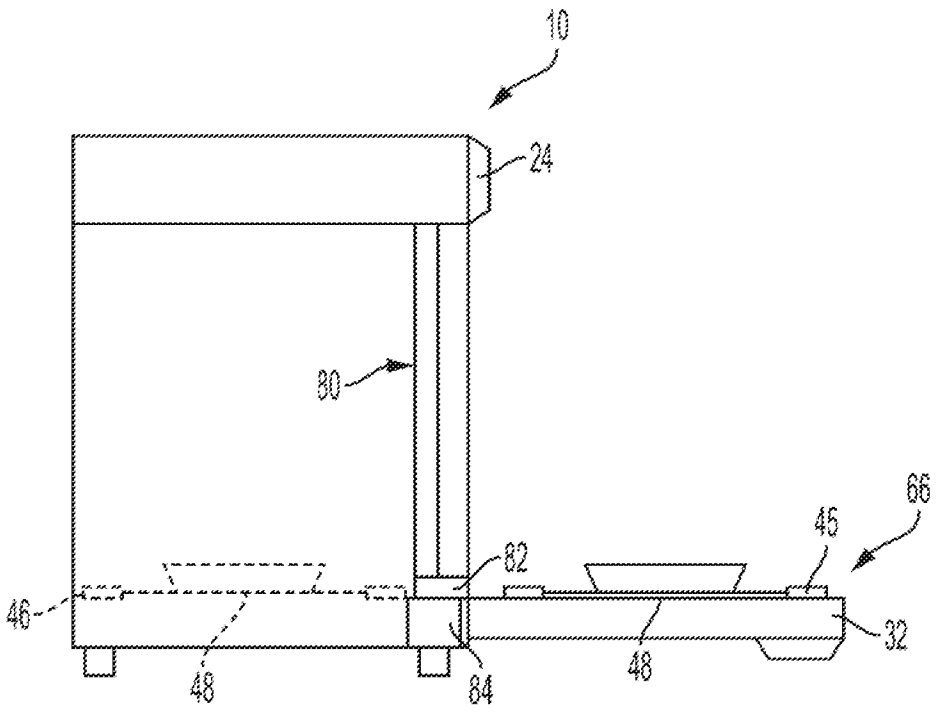
FIG. 3 schematic side view of the cooking appliance of FIG. 2 in an open configuration.
Figure 2:
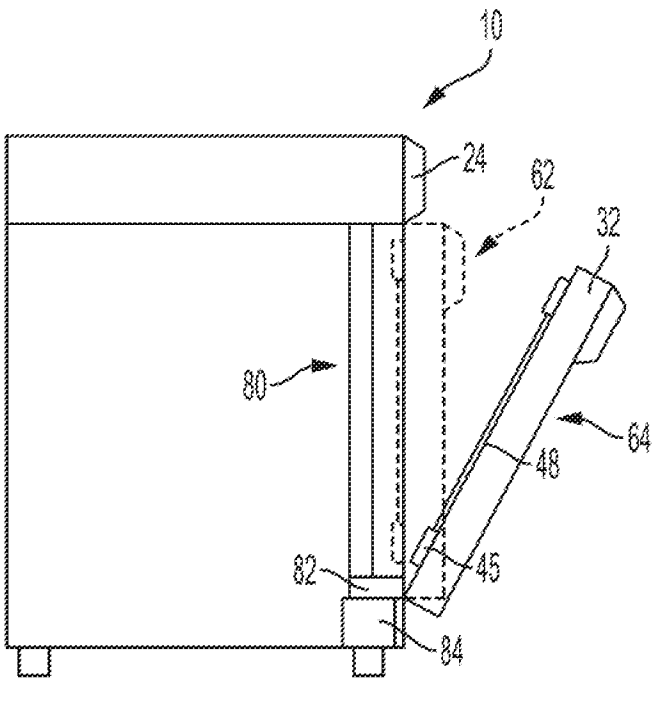
FIG. 2 is a schematic side view of an illustrative cooking appliance according to the present teachings, depicting a closed configuration and a partially-open configuration.

FIGS. 2 and 3 are schematic side views of cooking appliance 10. FIG. 2 shows cooking appliance 10 in a closed configuration 62 and in a first partially-open configuration 64. FIG. 3 shows cooking appliance 10 in a fully open position 66. Door 32 is pivotable between closed configuration 62 and open configuration 66, passing through a plurality of partially-open positions 64. At closed position 62, door 32 is substantially vertical, and is disposed parallel to and in contact with front surface 26 of housing 14. Door 32 completely covers and/or seals appliance cavity 20 in this configuration. Door 32 may include a gasket, seal, and/or other sealing/insulating mechanisms configured to contain heat within the cavity of the cooking appliance. In open configuration 66, door 32 is substantially horizontal, and disposed parallel to an underlying surface supporting appliance 10 (e.g., the floor of a kitchen). At any of the plurality of partially-open positions 64, door 32 may be disposed at an acute angle with respect to front surface 26 of housing 14.

Rack 48 may be slidably translatable between rack receiver 45 disposed on interior surface 44 of door 32 and rack receivers 46 disposed on muffle wall 18 at the open position of door 32. Cavity rack receivers 46 may form a substantially horizontal plane with the rack receivers 45 disposed on interior surface 44 of door 32 in the open configuration of the door. In some embodiments, no rack receivers 45 may be disposed on interior surface 44 of door 32 and rack 48 may slide from cavity rack receivers 46 onto interior surface 44 of door 32. An object received within the cooking appliance may also slide from an interior horizontal surface of appliance body 12 onto interior surface 44 of door 32. The interior horizontal surface of appliance body 12 may be a stationary oven rack or tray.

Figure 11:
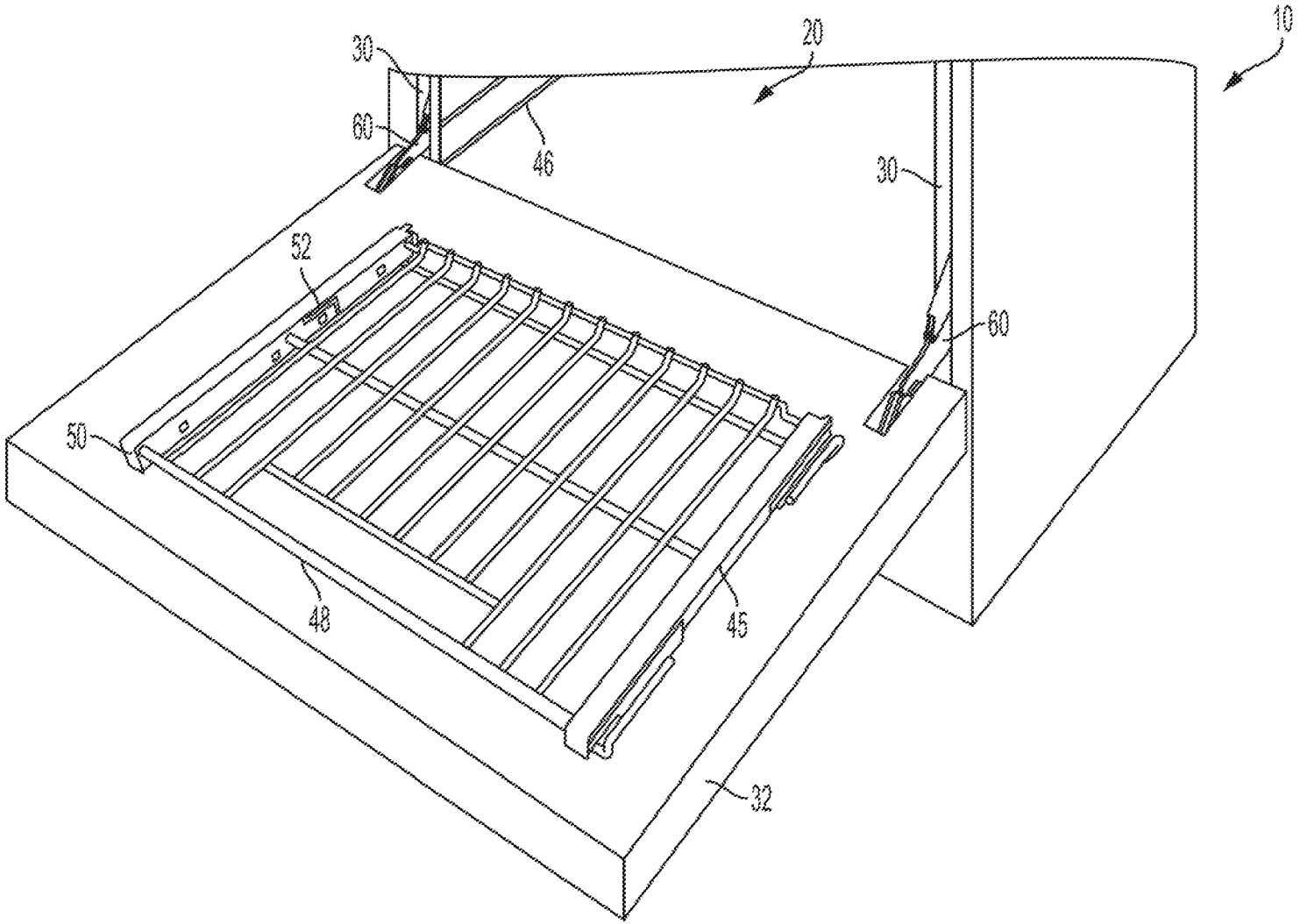
FIG. 11 is a partial isometric view of an illustrative cooking appliance having a rack and rack receivers in accordance with aspects of the present disclosure.

Turning briefly to FIG. 11, an illustrative rack and rack receiver arrangement is depicted. Rack 48 is shown slidably received within rack receiver 45 disposed on interior surface 44 of door 32. Rack 48 may comprise a metal, e.g., stainless steel or copper wire. Rack 48 may have a width substantially similar to a width of appliance cavity 20. Door 32 is shown in a position aligned with an interior rack receiver 46. Rack 48 slides directly between the interior rack receiver 46 and the door rack receiver 45. In some embodiments, door 32 does not include a rack receiver. In those examples, an item or rack 48 may rest on the interior surface of the door.

In some embodiments, rack 48 and door rack receiver 45 may be two parts of a set of drawer-bearings. For example, door rack receiver 45 may include a pair of rectangular housings configured to receive lateral edges of rack 48. Lateral edges of rack 48 may be substantially rectangular, with a groove disposed at a top surface of the rack. One rectangular housing of door rack receiver 45 may contact rack 48 on a respective lateral edge. The housing may extend to contact a top surface of rack 48. Door rack receiver 45 may be secured to appliance door 32 using hooks received into grooves disposed on interior surface 44. In some embodiments, door rack receiver 45 may be bolted, welded, soldered, or otherwise affixed to door 32. Cavity rack receiver(s) 46 may be substantially similar to door rack receiver 45.

In some examples, lateral edges of rack 48 may include structural wires. Cavity rack receivers 46 may include grooves or slots within appliance cavity 20 and door rack receiver 45 may include grooves or slots disposed on interior surface 44 of appliance door 32. In some examples, rack 48 may include rollers secured to brackets disposed on lateral edges of the rack. Rack receivers 45 and/or 46 may include tracks or rails along which the rollers can roll. The rollers of rack 48 may include bearings.

Door rack receiver 45 may include stops 50 disposed at ends of the rack receivers. In some embodiments, stops 50 are formed by an end of an external rectangular housing of a drawer fitting or by an end of a track or groove forming one of the rack receivers. In some embodiments, each stop 50 may be a pin extending vertically from a track or groove included within rack receiver 45.

Rack receiver 45 may further include locking mechanisms 52. Locking mechanisms 52 may include pins, hooks, or fasteners configured to mate with holes disposed along lateral edges of rack 48. Releasing locking mechanisms 52 may include pushing rack 48 toward the oven cavity and/or actuating a release mechanism such as a pair of buttons disposed on lateral edges of rack receiver 45.

FIG. 11 also depicts a nonexclusive example of hinge 60. In this embodiment, hinge 60 includes adjustable concealed hinges having three pivotably coupled arms extending from a hinge body received within hardware compartment 22.

Figure 5:
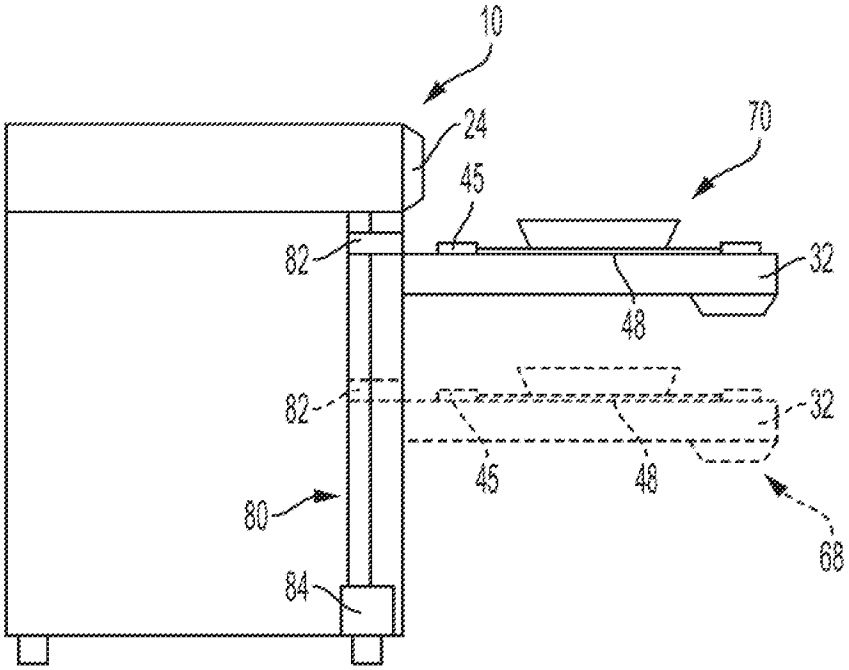
FIG. 5 is a schematic side view of the illustrative cooking appliance of FIG. 2, depicting two raised configurations of the door.
Figure 4:
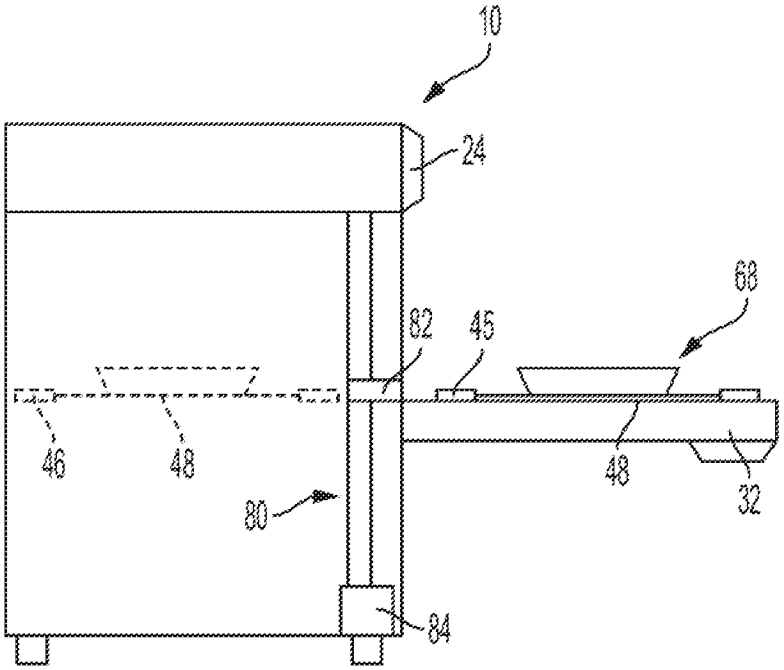
FIG. 4 is schematic side view of the illustrative cooking appliance of FIG. 2 in a first raised configuration.

Turning now to FIGS. 4-5, additional side views of cooking appliance 10 are provided. FIG. 4 shows door 32 in a first raised configuration 68. Door 32 is vertically translatable between open position 66 and first raised configuration 68 using linear actuator 80, which is disposed within hardware cavity 22. Linear actuator 80 is coupled to door 32 by hinge 60, which is coupled to carriage 82 of the linear actuator.

FIG. 5 shows two positions of door 32: first raised configuration 68 disposed at a first height and a second raised configuration 70 disposed at a second height. Door 32 may be transitionable between a plurality of heights. These heights may be continuously variable or discrete, e.g., selected to correspond with the positions of rack receivers within the appliance cavity. The heights may also be chosen by the user, e.g., through selectively activating and deactivating the linear actuator.

Linear actuator 80 may include any suitable lifting system, including a leadscrew-collar system, a pneumatic system, a hydraulic system, a counterbalance system, a spring-assisted system, and/or any other suitable systems configured to linearly translate a load from a first height to a second height. In the examples shown herein, linear actuator 80 includes carriage 82 which is coupled to hinge 60 in a fixed manner. A drive motor 84 of the linear actuator may include a DC, stepping, or induction motor. Drive motor 84 may be operated by HMI 23, which may include a button, switch, lever, toggle, touch-screen interface, or other mechanism for activating an electro-mechanical system. In some embodiments, linear actuator 80 includes a motor controller coupled to the drive motor. The motor controller may be configured to count screw revolutions to determine door height and/or achieve specific heights.

Linear actuator 80 may comprise a pair of linear actuators substantially as described herein, with one linear actuator disposed on either side of the door. In some examples, hinge 60 may be coupled to a linear bearing 81 on one or both sides of the door. In some examples, one side of the door is coupled to a linear actuator and the other side of the door is coupled to a linear bearing. Linear bearings may include any suitable load-bearing surface configured to guide the door as it moves up and down, such as a channel bearing, rod bearing, and/or the like.

Figure 7:
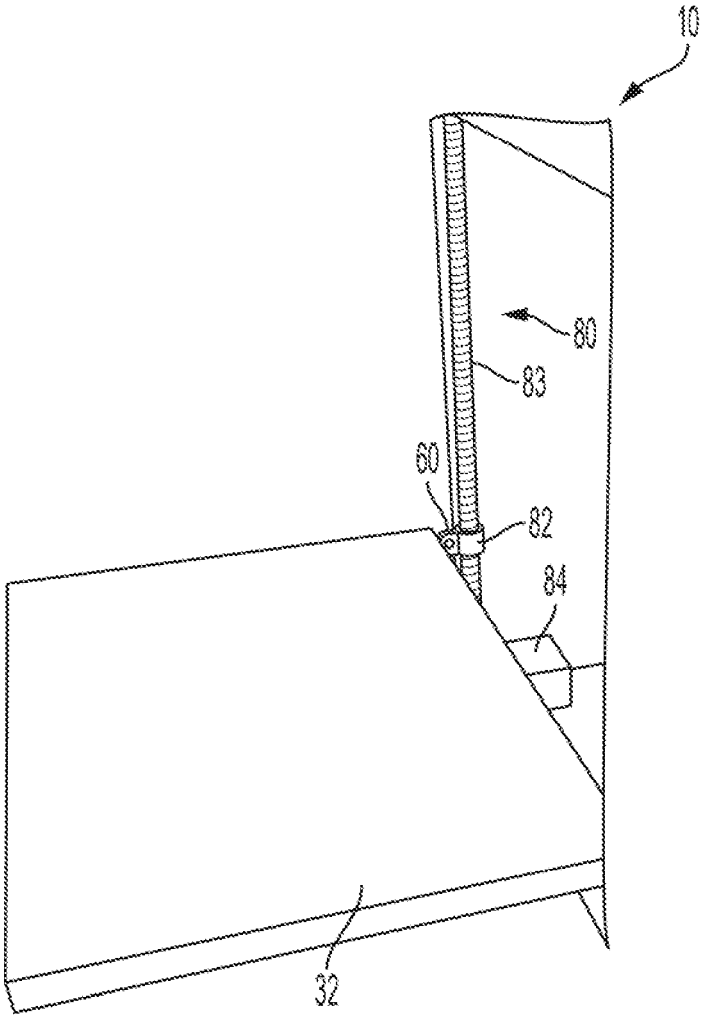
FIG. 7 is a partial isometric view of an illustrative linear actuator suitable for use with cooking appliances as described herein.
Figure 8:
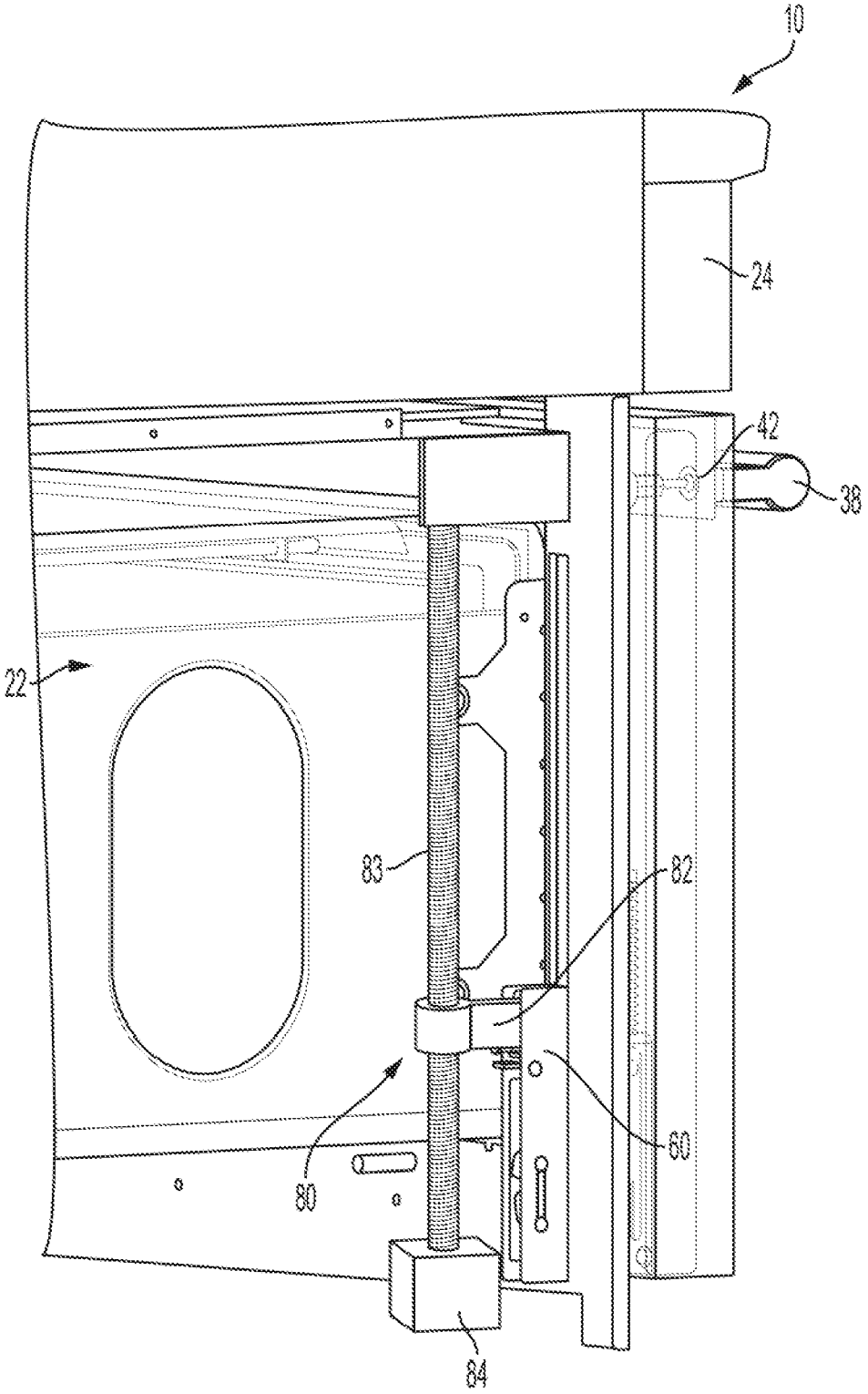
FIG. 8 is a partial isometric view of another illustrative linear actuator suitable for use with cooking appliances as described herein.

FIGS. 7 and 8 depict further details of linear actuator 80. The linear actuator of FIGS. 7 and 8 is an electro-mechanical screw actuator received within hardware compartment 22 of appliance body 12. Linear actuator 80 includes a leadscrew 83, alternatively and interchangeably referred to as a power screw or translation screw configured to drive carriage 82 up and down. Carriage 82 is coupled to hinge 60, which is further coupled to door 32 of appliance 10. Carriage 82 is internally threaded, encircling leadscrew 83. Linear actuator 80 translates door 32 along a linear axis defined by leadscrew 83. Leadscrew 83 is attached to appliance housing 14 at a top surface and at a bottom surface. Leadscrew 83 may be reinforced with brackets coupled to the top and bottom surface of appliance housing 14.

Leadscrew 83 and carriage 82 may include square thread forms, acme thread forms, buttress thread forms, or any other suitable type of mating thread form. The selected thread form may be self-locking. In some embodiments, leadscrew 83 may include a ball screw or roller screw. Carriage 82 may include a counterweight situated opposite hinge 60, configured to balance non-vertical forces experienced by the leadscrew. The thread patterns of leadscrew 83 and carriage 82 may have a coarseness or thread pitch selected to produce a specific speed of linear motion and positioning precision.

Linear actuator 80 may be actuated by one or more user-selected methods. In some embodiments, the user may activate HMI 88, which is configured to selectively activate drive motor 84. In some embodiments, HMI 88 may be coupled to a hydraulic or pneumatic actuator. In some embodiments, HMI 88 may comprise manually exerting an upward force on door 32. In some examples, a door position switch may sense an orientation and/or height of door 32. The position switch may be coupled to controls that ensure the door is vertically translatable only when in a fully horizontal position. In other words, an interlock may be provided to prevent raising/lowering of the door unless the door is fully opened and/or within an acceptable range of heights.

Door 32 may be transitionable between a plurality of selected heights (e.g., discrete or infinitely adjustable). The motor controller may stop the linear actuator at one or more predetermined height during vertical movement. In another embodiment, the motor controller may halt movement at a specific height selected by the user (e.g., using HMI 88). In some embodiments, appliance 10 may include a plurality of mechanical stops or switches configured to halt the linear actuator at one or more predetermined heights.

Drive motor 84 is operably connected to leadscrew 83. As motor 84 rotates the leadscrew, carriage 82 moves up and down along the leadscrew, depending on a direction of rotation. Motor 84 may be operable at one or more speeds, e.g., selectable by the user. Motor 84 may be controlled by way of HMI 88. For example, motor 84 may be activated by the pressing of a button, the movement of a toggle or switch from a first position to a second position, or any other suitable interaction with a user interface. The user may continually activate HMI 88 (e.g., holding down a button) until the door is positioned at a desired height. The user may initiate motor function and halt motor function in separate steps (e.g., moving a switch to an "on" position and then moving a switch to an "off" position when the desired height is reached).

Motor 84 may include a motor controller. The motor controller may be configured to count rotations of motor 84 and/or leadscrew 83. The motor controller may be configured to transition door 32 between a variety of predetermined heights. The heights may correspond to the position of rack receivers 46 within cavity 20. The motor controller may be activated by HMI 88. For example, the user may activate the motor controller by selecting a position from a predetermined menu using a touch screen, by pressing a button corresponding to a specific door position, etc.

C. Second Illustrative Cooking Appliance

Figure 6:
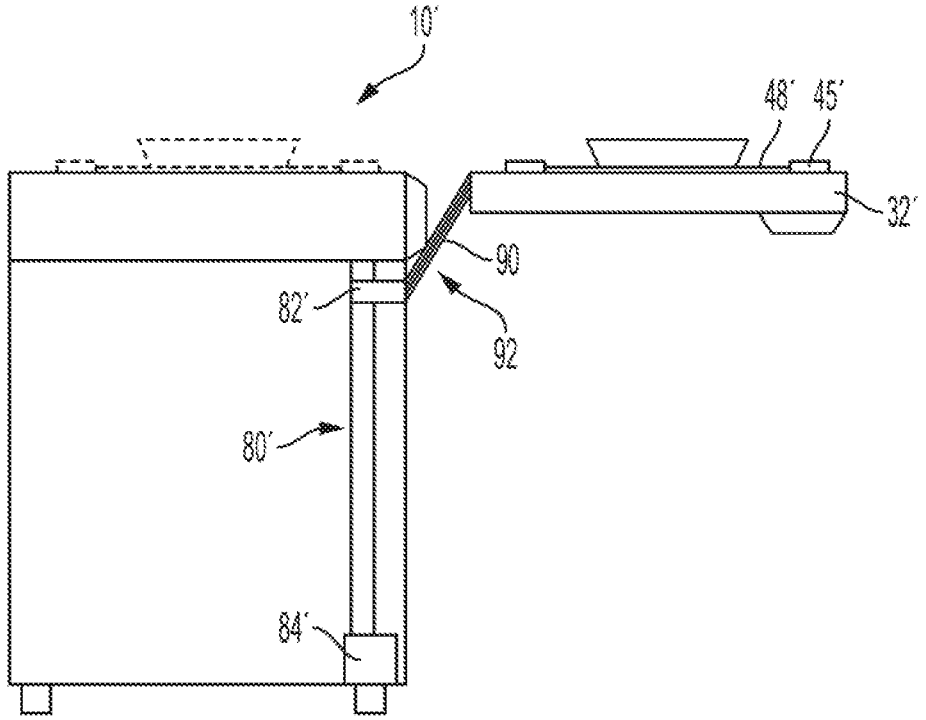
FIG. 6 is a side schematic view of another illustrative cooking appliance having a door in an extended position in accordance with aspects of the present disclosure.

As shown in FIG. 6, this section describes an illustrative cooking appliance 10' including a load-bearing, height-adjustable door and a collapsible/extendable hinge.

FIG. 6 shows cooking appliance 10', wherein the appliance door is transitionable above the fully raised position to an extended position by way of an extendable hinge apparatus 90. Appliance 10' is substantially similar to cooking appliance 10, with an extendable hinge 90 (AKA a collapsible hinge) replacing hinge 60. Hinge 90 may include a four-bar linkage in the form of a spring-loaded scissor-hinge. Hinge 90 couples a door 32' to a carriage 82' of a linear actuator 80'. Door 32' is disposed at a second height and a second horizontal position in the fully raised position. Transitioning door 32' from the fully raised position to the extended position brings the door upward and away from the remainder of the appliance. In other words, this action vertically displaces the door to a third height above the second height and horizontally displaces the door to a third horizontal position with the door spaced apart from the appliance body.

Transitioning door 32' into the extended position includes transitioning hinge 90 from a collapsed configuration to an extended configuration. Extending hinge 90 allows door 32' to avoid a control panel 24' disposed on a front surface 26' of appliance 10'. With hinge 90 in an extended position 92, door 32' may be substantially coplanar with a cooktop or countertop. An object or rack 48' may be slidably transitionable between an interior surface 44' of door 32' and a cooktop or countertop surface.

Figure 9:
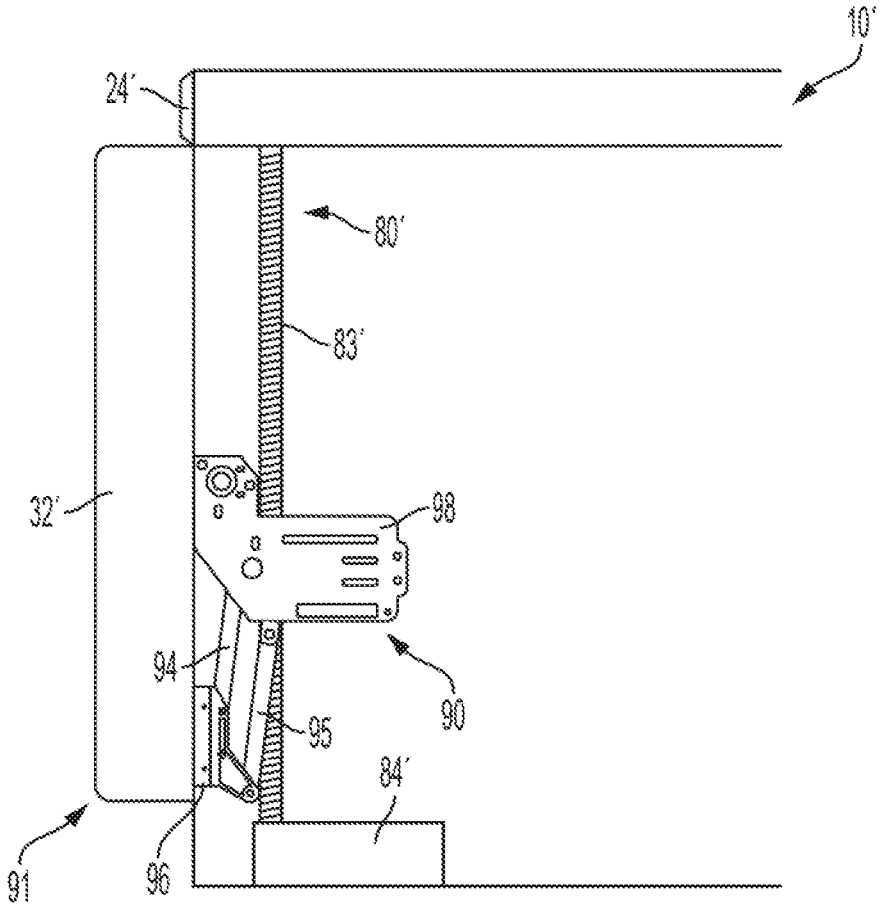
FIG. 9 is a partial side elevation view of another illustrative cooking appliance having a door in a closed configuration, depicting an illustrative hinge mechanism in accordance with aspects of the present disclosure.
Figure 10:
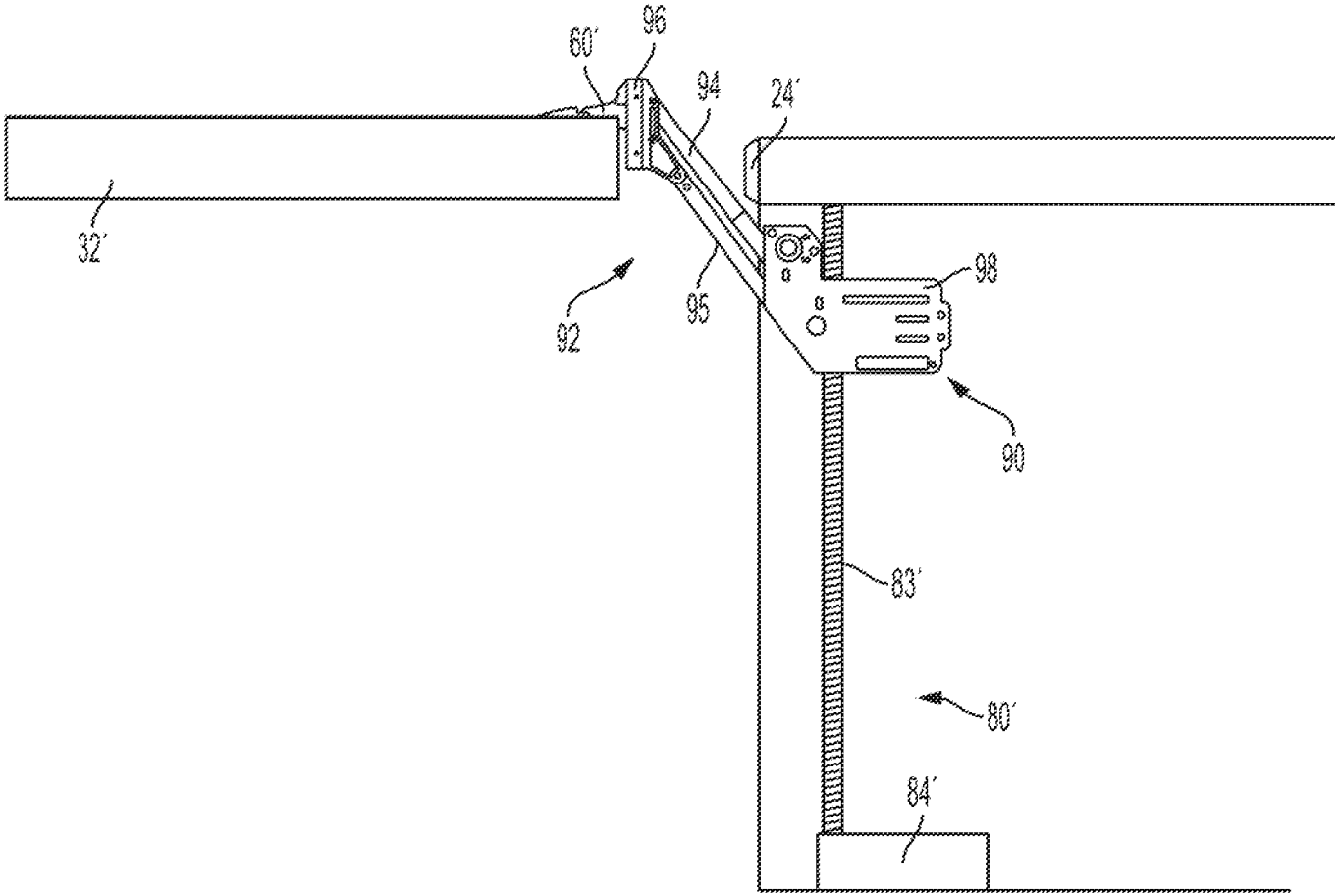
FIG. 10 depicts the cooking appliance of FIG. 9 with the door in an extended configuration.

FIGS. 9 and 10 depict hinge 90 in two different configurations or states. Hinge 90 is received within hardware compartment 22' of appliance body 12' in a collapsed state (see FIG. 9). Collapsible hinge 90 includes a first link 94, a second link 95, a hinge attachment block 96, and a spring housing 98 coupled to carriage 82'. First and second links 94 and 95 couple hinge attachment block 96 to spring housing 98. First link 94 may have a fixed length and be pivotable about a first axis. Second link 95 may extend pivotably from spring housing 98 and attach to an extension of block 96. Hinge attachment block 96 may include a vertically-oriented panel coupled to an adjustable concealed hinge 60', as shown in FIG. 11. Spring housing 98 is coupled to carriage 82' of linear actuator 80', and may include a first spring coupled to second link 95. Spring housing 98 may include additional springs that may be coupled to first and second mechanical links 94 and 95. In some embodiments, spring housing 98 includes a counterweight configured to counterbalance door 32' and reduce undesired torque on leadscrew 83'.

FIG. 9 shows hinge 90 in a collapsed configuration 91. Door 32' is shown in closed position 62'. First link 94 is pivoted to be nearly parallel to door 32'. Second link 95 is folded at an acute angle with the extension of block 96. Interior surface 44' of door 32' is substantially parallel to and in contact with hinge attachment block 96. Door 32' is closed. Hinge 90 may be secured or locked in the collapsed configuration in closed position 62', open position 66', first and second raised positions 68' and 70', and any of the plurality of partially-open positions 64'.

FIG. 10 shows hinge 90 in extended configuration 92. Hinge 90 may be transitioned from collapsed configuration 91 to extended configuration 92 by pulling door 32' away from appliance body 12'. Pulling door 32' away from appliance body 12' may release locking mechanisms disposed on hinge attachment block 96 and links 94 and 95. First link 94 and second link 95 are disposed at an obtuse angle with respect to front surface 26' of appliance housing 14' in the extended configuration. Door 32' is substantially parallel to the floor. Hinge 90 may also include one or more locking mechanisms configured to secure door 32' in the extended configuration. Spring housing 98 may include brackets or appendages that provide support to links 94 and 95 by securing joints in an extended configuration or bracing the hinge.

G. First Illustrative Method

Figure 12:
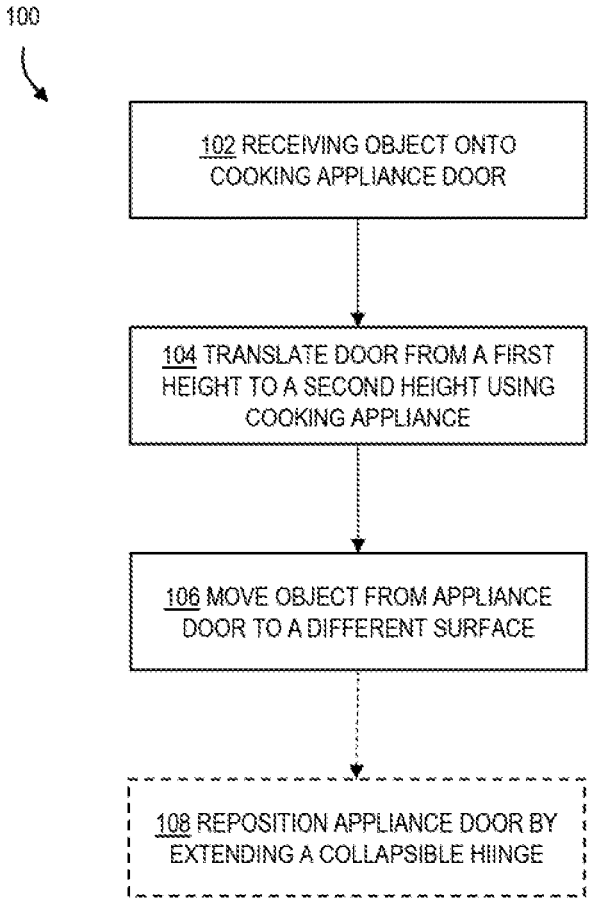
FIG. 12 is a flow chart depicting steps of an illustrative method for relocating an item using a cooking appliance.

This section describes steps of an illustrative method 100 for transporting an object from a first height to a second height in relation to a cooking appliance; see FIG. 12. Aspects of previously described cooking appliances may be utilized in the method steps described below. Where appropriate, reference may be made to components and systems that may be used in carrying out each step. These references are for illustration, and are not intended to limit the possible ways of carrying out any particular step of the method.

FIG. 12 is a flowchart illustrating steps performed in method 100, and may not recite the complete process or all steps of the method. Although various steps of method 100 are described below and depicted in FIG. 12, the steps need not necessarily all be performed, and in some cases may be performed simultaneously or in a different order than the order shown.

At step 102, an object (e.g. an item of food, cookware, or bakeware) is received onto a door of a cooking appliance, which is oriented in a horizontal, or fully open, configuration.

At step 104, the cooking appliance translates (i.e., raises or lowers) the door from a first height to a second height. This step may be performed using a linear actuator included within the cooking appliance. The linear actuator may include any suitable mechanism configured to move a load vertically in a controlled fashion, such as a leadscrew, pneumatic piston, hydraulic piston, or the like. In some embodiments, translating the door from the first height to the second height includes receiving an input from a human-machine interface and, in response, activating the linear actuator. The human-machine interface may include any suitable user interface element, any suitable mechanical or virtual user interface configured to allow an operator to communicate information to the controller, or to carry out one or more functions of the controller itself. For example, a user interface may include one or more manipulable controls such as a lever, dial, switch, slider, pushbutton, keypad, and/or knob, any of which may be implemented mechanically or virtually, such as via a graphical user interface (GUI) on a screen or other display. Any manipulable control may be manipulated by a body part of the user. In some examples, the user interface may include a voice interface capable of speech recognition, through which the operator may provide voice commands. In some examples, a user interface may include a portable or wearable computing device, such as a wrist- or head-mounted interface, or a mobile digital device such as a smartphone or tablet.

In some examples, translating the door from the first height to the second height includes having an upward or downward force applied to the appliance door (or a handle thereof), e.g., by the user (e.g., by hand or by foot). Applying pressure to an outer surface of the appliance door, for example, may activate the linear actuator system.

At step 106, the object may be moved from the appliance door to a different surface. In some examples, this step may include sliding a wire rack supporting the object from a first rack receiver disposed on an interior surface of the appliance door to a position on top of the appliance, or into a second rack receiver disposed in the cooking appliance cavity.

In some examples, a step 108 may include repositioning the appliance door by extending a collapsible hinge thereof. When in a fully raised position, the door may be relocated to a greater height and moved away from the face of the appliance, such that the horizontal and vertical positions of the door are both changed. In some examples, the final height is substantially coplanar with a height of the appliance, such that relocation of items between the door surface and the appliance top is facilitated. This step may be reversed, collapsing the hinge and placing the door adjacent the face of the appliance. The hinge may be lockable in the extended and/or collapsed positions, to prevent unwanted movement.

H. Second Illustrative Method

Figure 13:
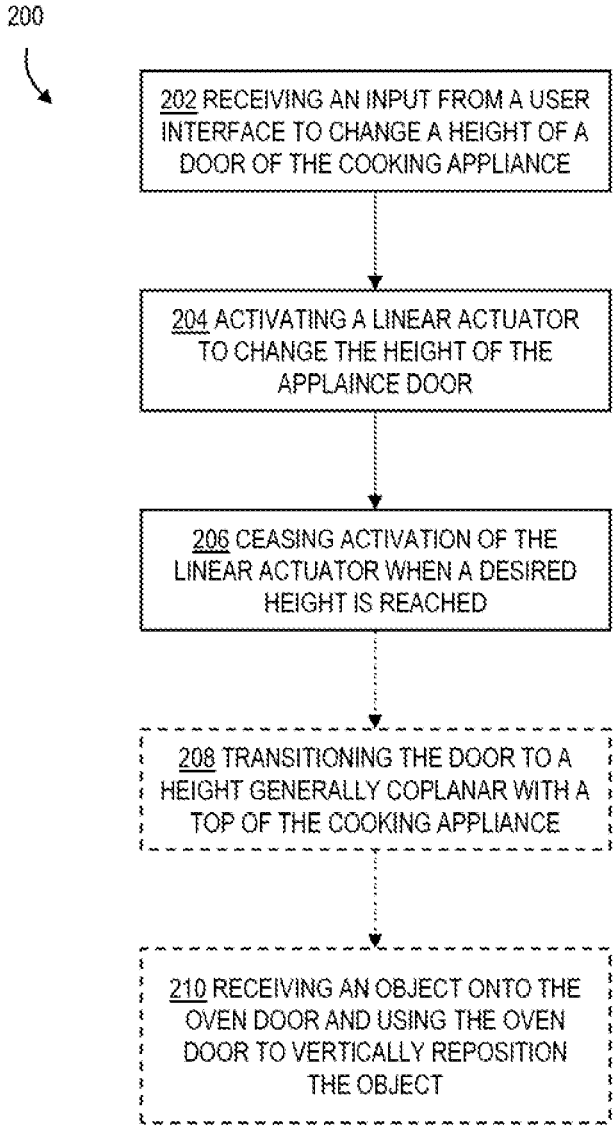
FIG. 13 is a flow chart depicting steps of an illustrative method for vertically repositioning a door of a cooking appliance.

This section describes steps of an illustrative method 200 for vertically repositioning a door of a cooking appliance; see FIG. 13. Aspects of previously described cooking appliances may be utilized in the method steps described below. Where appropriate, reference may be made to components and systems that may be used in carrying out each step. These references are for illustration, and are not intended to limit the possible ways of carrying out any particular step of the method.

FIG. 13 is a flowchart illustrating steps performed in method 200, and may not recite the complete process or all steps of the method. Although various steps of method 200 are described below and depicted in FIG. 13, the steps need not necessarily all be performed, and in some cases may be performed simultaneously or in a different order than the order shown.

Step 202 includes receiving, at a controller, an input from a user interface, the input indicating a first command to change a height of a door of the cooking appliance, wherein the door is manually pivotable about a horizontal axis.

Step 204 includes, in response to a sensed input indicating that the door is open, activating a linear actuator to change the height of the door. The linear actuator may include a carriage coupled to a leadscrew. The controller may include a motor controller configured to control a motor coupled to the leadscrew.

Step 206 includes ceasing activation of the linear actuator when a desired height is reached. This may include ceasing activation of the linear actuator in response to a second command. In some examples, activating the linear actuator is continued until the first command ceases to be received. In some examples, activating the linear actuator is continued until a selected height is reached (as indicated by a position switch, revolution counter, user selection, etc.).

Step 208 may include (optionally): when the oven door is fully raised with respect to the linear actuator, responding to an outward and upward force on the door by transitioning the door to a height generally coplanar with a top of the cooking appliance. This transitioning may be effected by way of a four-bar linkage coupled to a hinge of the door.

Step 210 may include (optionally): receiving an object onto the oven door and using the oven door to vertically reposition the object.

I. Illustrative Combinations and Additional Examples

This section describes additional aspects and features of cooking appliances having doors that raise and lower, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A cooking appliance comprising:

an appliance body;

an appliance door coupled to the appliance body, such that the appliance door is pivotable between a horizontal, fully open position and a vertical, fully closed position; and a linear actuator operatively connected to the appliance door such that the linear actuator is selectively operable to raise the appliance door along a vertical axis when the appliance door is in the fully open position.

A1. The cooking appliance of A0, wherein the appliance body comprises an oven.

A2. The cooking appliance of A0 or A1, wherein the appliance door is coupled to the linear actuator by a first hinge disposed on a first side of the door and a second hinge disposed on a second side of the door.

A3. The cooking appliance of A2, wherein the linear actuator is coupled to the first hinge.

A4. The cooking appliance of A3, wherein the second hinge is coupled to a vertical guide bearing.

A5. The cooking appliance of A3, further comprising a second linear actuator coupled to the second hinge.

A6. The cooking appliance of any one of paragraphs A0 through A5, wherein the linear actuator comprises a leadscrew.

A7. The cooking appliance of A6, wherein the leadscrew is coupled to a stepper motor.

A8. The cooking appliance of any one of paragraphs A0 through A7, further comprising an interlock configured to prevent operation of the linear actuator unless the appliance door is in the fully open position.

A9. The cooking appliance of any one of paragraphs A0 through A8, wherein the hinge comprises an extendable four-bar linkage configured to pivot the appliance door upward and away from a face of the appliance.

A10. The cooking appliance of A9, wherein, when the appliance door is in a fully raised position with respect to the linear actuator, the four-bar linkage is transitionable between a collapsed configuration, in which the appliance door is at a first height, and an extended configuration, in which the appliance door is at a second height, wherein the second height is generally coplanar with a top surface of the cooking appliance.

A11. The cooking appliance of A10, wherein the extended configuration further comprises the appliance door being repositioned outward from a face of the cooking appliance.

B0. A cooking appliance, comprising:

an oven having an oven cavity and an oven door configured to open and close the oven cavity by pivoting about a horizontal axis;

a cooktop disposed above the oven; and a linear actuator coupled to the oven door and configured to reposition the oven door in a vertical direction.

B1. The cooking appliance of B0, wherein the linear actuator comprises a vertically-oriented leadscrew.

B2. The cooking appliance of B0 or B1, wherein the linear actuator is coupled to one or more hinges of the oven door.

B3. The cooking appliance of any one of paragraphs B0 through B2, wherein the linear actuator comprises a pair of linear actuators, one linear actuator on either side of the oven door.

B4. The cooking appliance of any one of paragraphs B0 through B3, further comprising one or more linear bearings configured to guide the oven door during repositioning thereof.

B5. The cooking appliance of any one of paragraphs B0 through B4, further comprising an interlock preventing activation of the linear actuator unless the oven door is in a horizontal position.

B6. The cooking appliance of any one of paragraphs B0 through B5, wherein the oven door is coupled to the linear actuator by one or more hinges, and each of the one or more hinges comprises an extendable four-bar linkage configured to relocate the oven door away from a face of the oven.

B7. The cooking appliance of B6, wherein the extendable four-bar linkage is further configured to reposition the oven door between a fully-raised position relative to the linear actuator and an extended-height position substantially level with a surface of the cooktop.

C0. A method for vertically repositioning a door of a cooking appliance, the method comprising:

receiving, at a controller, an input from a user interface, the input indicating a first command to change a height of a door of the cooking appliance, wherein the door is manually pivotable about a horizontal axis; and in response to a sensed input indicating that the door is open, activating a linear actuator to change the height of the door.

C1. The method of C0, further comprising:

in response to a second command, ceasing activation of the linear actuator.

C2. The method C0 or C1, wherein activating the linear actuator is continued until the first command ceases to be received.

C3. The method of any one of paragraphs C0 through C2, wherein activating the linear actuator is continued until a selected height is reached.

C4. The method of any one of paragraphs C0 through C3, wherein the linear actuator comprises a carriage coupled to a leadscrew.

C5. The method of C4, wherein the controller comprises a motor controller configured to control a motor coupled to the leadscrew.

C6. The method of any one of paragraphs C0 through C5, further comprising:

when the oven door is fully raised with respect to the linear actuator, responding to an outward and upward force on the door by transitioning the door to a height generally coplanar with a top of the cooking appliance.

C7. The method of C6, wherein the transitioning is effected by way of a four-bar linkage coupled to a hinge of the door.

C8. The method of any one of paragraphs C0 through C7, further comprising receiving an object onto the oven door and using the oven door to vertically reposition the object.

Advantages, Features, and Benefits

The different embodiments and examples of the cooking appliance described herein provide several advantages over known solutions for placing items into and removing items from a cooking appliance. For example, illustrative embodiments and examples described herein allow an object to be transported into and out of the cooking appliance without a user of the appliance lifting the object while in bent or stooped position.

Additionally, and among other benefits, illustrative embodiments and examples described herein allow a user of the cooking appliance to move an item from a first height within the appliance to a second height within the appliance without removing the item from the appliance apparatus. The user may move items or racks to different positions within the appliance cavity without needing to set the items on a cooktop or countertop as an intermediate step, as is common with other known cooking appliance systems.

Additionally, and among other benefits, illustrative embodiments and examples described herein may assist a user in lifting up to seventy pounds of cooking appliance contents. As many users may be unable to lift heavy objects from a stooped or bent position, this may allow users to cook or heat larger objects than in known systems.

No known system or device can perform these functions, particularly assisting users in transporting heatable items into and out of cooking appliances. Thus, the illustrative embodiments and examples described herein are particularly useful for elderly or disabled users who may be unable to maneuver items in and around cooking appliances. However, not all embodiments and examples described herein provide the same advantages or the same degree of advantage.

Conclusion

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A cooking appliance comprising:

an appliance body;

an appliance door coupled to the appliance body by a first hinge disposed at a bottom edge of the appliance door, such that the appliance door is pivotable about an axis defined by the first hinge between a horizontal, fully open position and a vertical, fully closed position; and a linear actuator operatively connected to the appliance door by the first hinge such that the linear actuator is selectively operable to translate the appliance door along a vertical axis when the appliance door is in the horizontal, fully open position, such that the appliance door maintains the horizontal, fully open position while translating along the vertical axis.

2. The cooking appliance of claim 1, wherein the appliance body comprises an oven.

3. The cooking appliance of claim 1, wherein the appliance door is pivotably coupled to a vertical guide bearing by a second hinge.

4. The cooking appliance of claim 1, wherein the first hinge comprises an extendable four-bar linkage configured to translate the appliance door upward and pivot the appliance door away from a face of the appliance.

5. The cooking appliance of claim 1, wherein the linear actuator comprises a leadscrew coupled to a stepper motor.

6. A cooking appliance, comprising:

an oven having an oven cavity and an oven door configured to open and close the oven cavity by pivoting about a horizontal axis defined by a first hinge coupled to a bottom edge of the oven door;

a cooktop disposed above the oven; and a first linear actuator coupled to the oven door by the first hinge and configured to translate the oven door along a vertical axis defined by the linear actuator when the appliance door is oriented in a horizontal position, such that the oven door maintains the horizontal position while translating along the vertical axis.

7. The cooking appliance of claim 6, wherein the linear actuator comprises a vertically-oriented leadscrew.

8. The cooking appliance of claim 6, wherein the first linear actuator is disposed on a first side of the oven door, and further comprising a second linear actuator disposed on a second side of the oven door.

9. The cooking appliance of claim 6, further comprising one or more linear bearings configured to guide the oven door during repositioning thereof.

10. The cooking appliance of claim 6, further comprising an interlock configured to prevent activation of the linear actuator unless the oven door is in a horizontal position.

11. The cooking appliance of claim 6, wherein the oven door is coupled to the linear actuator by one or more hinges, and each of the one or more hinges comprises an extendable four-bar linkage configured to relocate the oven door away from a face of the oven.

12. The cooking appliance of claim 11, wherein the extendable four-bar linkage is further configured to reposition the oven door between a fully-raised position relative to the linear actuator and an extended-height position substantially level with a surface of the cooktop.

13. The cooking appliance of claim 6, further comprising a door rack receiver disposed on an inner surface of the oven door, wherein the rack receiver is configured to slidably receive a wire rack.

14. A cooking appliance comprising:

an appliance body;

an appliance door coupled to the appliance body by a first hinge disposed at a bottom edge of the appliance door, such that the appliance door is pivotable about an axis defined by the first hinge between a horizontal, fully open position and a vertical, fully closed position;

a linear actuator operatively connected to the appliance door by the first hinge such that the linear actuator is selectively operable to translate the appliance door along a vertical axis when the appliance door is in the horizontal, fully open position; and a door rack receiver disposed on an inner surface of the door, wherein the rack receiver is configured to slidably receive a wire rack.

15. The cooking appliance of claim 14, wherein the wire rack is slidably transitionable between the door rack receiver and at least one cavity rack receiver disposed within the appliance body.

* * * * *